United States Patent [19]

Vick

[11] Patent Number: 4,878,419

[45] Date of Patent: Nov. 7, 1989

[54] LIGHTWEIGHT HYDRAULIC ACTUATOR

[75] Inventor: Ralph L. Vick, Granada Hills, Calif.

[73] Assignee: Allied-Signal Inc., Morris Township, Morris County, N.J.

[21] Appl. No.: 211,960

[22] Filed: Jun. 27, 1988

[51] Int. Cl.[4] ..... F01B 31/00

[52] U.S. Cl. ..... 92/163; 92/169.1; 277/227

[58] Field of Search ..... 92/128, 163, 164, 169.1, 92/255, 256; 277/227, 228; 403/355, 377; 285/13, 14, ; 220/3, 378

[56] References Cited

U.S. PATENT DOCUMENTS

| | | | |
|---|---|---|---|
| 2,145,384 | 1/1939 | Allin | 92/163 |
| 2,414,492 | 1/1947 | Urschel et al. | 92/164 X |
| 2,518,787 | 8/1950 | Huhtala | 92/164 |
| 2,536,565 | 2/1951 | Ostergren | 285/13 |
| 2,661,721 | 12/1953 | Sherwen | 92/163 |
| 2,953,118 | 9/1960 | Flick et al. | 92/164 |
| 2,969,997 | 1/1961 | Runton et al. | 277/227 X |
| 3,038,448 | 6/1962 | Corwin | 92/164 |
| 3,088,757 | 5/1963 | McIntosh | 92/164 |
| 3,195,422 | 7/1965 | Corwin | 92/164 |
| 3,648,348 | 3/1972 | Freimuth | 403/377 |
| 3,708,188 | 1/1973 | Flick | 403/355 X |
| 4,211,150 | 7/1980 | Framberg | 92/164 X |
| 4,268,040 | 5/1981 | Bainard et al. | 277/227 X |
| 4,452,128 | 6/1984 | Stoll | 92/163 |

FOREIGN PATENT DOCUMENTS

| | | | |
|---|---|---|---|
| 838670 | 7/1949 | Fed. Rep. of Germany | 403/377 |
| 3027267 | 2/1982 | Fed. Rep. of Germany | 92/169 |

*Primary Examiner*—Robert E. Garrett
*Assistant Examiner*—Thomas Denion
*Attorney, Agent, or Firm*—Robert C. Smith

[57] ABSTRACT

A lightweight linear hydraulic actuator which is unusually inexpensive to fabricate includes a cylindrical barrel of metal tubing material, a head end gland and a rod end gland fastened to the barrel, a piston and a rod in the barrel with the rod extending through the rod end gland, ports in the sidewall of the barrel on opposite sides of the piston and fitting members having channels in registry with the ports, the fitting members including hoop type attachments around the exterior surface of the barrel and a curved surface mating with the curvature of the barrel. A circular groove is formed in the surface of the barrel around each of the ports and an O-ring seal is located in the grooves sealing against the curved surface of the fitting member. An axial extension forming part of each of the fittings includes a boss receiving a threaded fastener for fastening the fittings to the barrel.

10 Claims, 1 Drawing Sheet

LIGHTWEIGHT HYDRAULIC ACTUATOR

The present invention relates to lightweight linear hydraulic actuators and more particularly to such an actuator which is comparatively simple in construction and inexpensive to manufacture.

Usual linear actuators, particularly for operating aircraft control surfaces, include a cylindrical barrel which may be cast or forged to include a head end with a structure for fastening the actuator to a stationary part of the aircraft or other vehicle. Alternatively, the head end may include a separate structure fastened to the barrel, but in either case the end structure usually will include a passage to allow hydraulic fluid to flow into and out of the cylinder. A piston attached to a rod is movable in the cylinder. At the opposite, or rod end of the barrel, a separate rod end gland is fastened to the barrel and this gland includes one or more seals surrounding the rod which passes through the barrel and usually also will include a passage to allow hydraulic fluid to flow into and out of the cylinder. Such passages may also be cast into the barrel if the barrel is cast. Similarly, the piston and rod may be cast or forged in one piece, or formed of separate pieces which are then secured together. Actuators incorporating such cast or forged components are usually quite expensive both because of the cost of castings and forgings but also because of the required machining. These costs are further escalated by whatever losses or scrap are caused by the machining operations.

There is a need for a lightweight linear actuator which will perform essentially as well as the expensive actuators described above but which is substantially less expensive to manufacture. It is known to make the cylinder barrel of metal tubing, to make the rod of conventional bar stock and to form the piston separately in any desired manner for attachment to the rod. These techniques reduce costs. There have been problem areas in the placement of the fluid ports, however, except in the cases where the geometry of the installation will permit installation of the ports in the rod end or head end glands. There is often a desire to have the ports parallel to the actuator axis to keep the actuator short and to keep the tube connection close to the actuator (to save space) without the potential of unthreading the port fitting during actuator use. Also, on a tandem actuator installation it is difficult to place all of the porting in head ends or rod end glands since these usually require transfer tube or quill type connections to a mating valve manifold.

Given the above described cost saving construction, the port fittings can sometimes be welded or brazed in place. On comparatively thin wall tubing, this sometimes results in high scrap and rework, at least partially because of distorting of the barrel.

Another known possibility is to add separate outer glands surrounding the barrel. This technique leaves much to be desired because the extra glands must be capable of withstanding pressure hoop stress and must seal on two extra and rather large diameter seals which adversely affects size, weight and reliability.

Applicant has devised a way of adding port fittings to an actuator of the type described which avoids the above problems and limitations. A cast or forged fitting including a thin hoop support structure surrounds the barrel and provides a channel with a threaded connection to a fluid source which channel registers with a port in the barrel. A small circular groove in the surface of the cylinder surrounds the port and receives an O-ring seal which seals against a curved surface of the fitting which mates with the curvature of the barrel. A suitable threaded fastener maintains the fitting securely in place. A superficial consideration of applicant's structure might cause one to think that the localized pressure generated force in the seal area would tend to increase the gap between the barrel outer diameter and the fitting such that the seal would fail. Applicant has found, however, that the localized force and resultant strain on the fitting is less than the barrel hoop strain (at the same pressure) if the fitting is designed properly Therefore, the initial face seal annular gap will tend to decrease with pressure rather than the reverse. Thus the fitting can be lightweight, has only one seal (potential leak path) and is readily removable and replaceable even with the actuator assembled.

Figure 1:
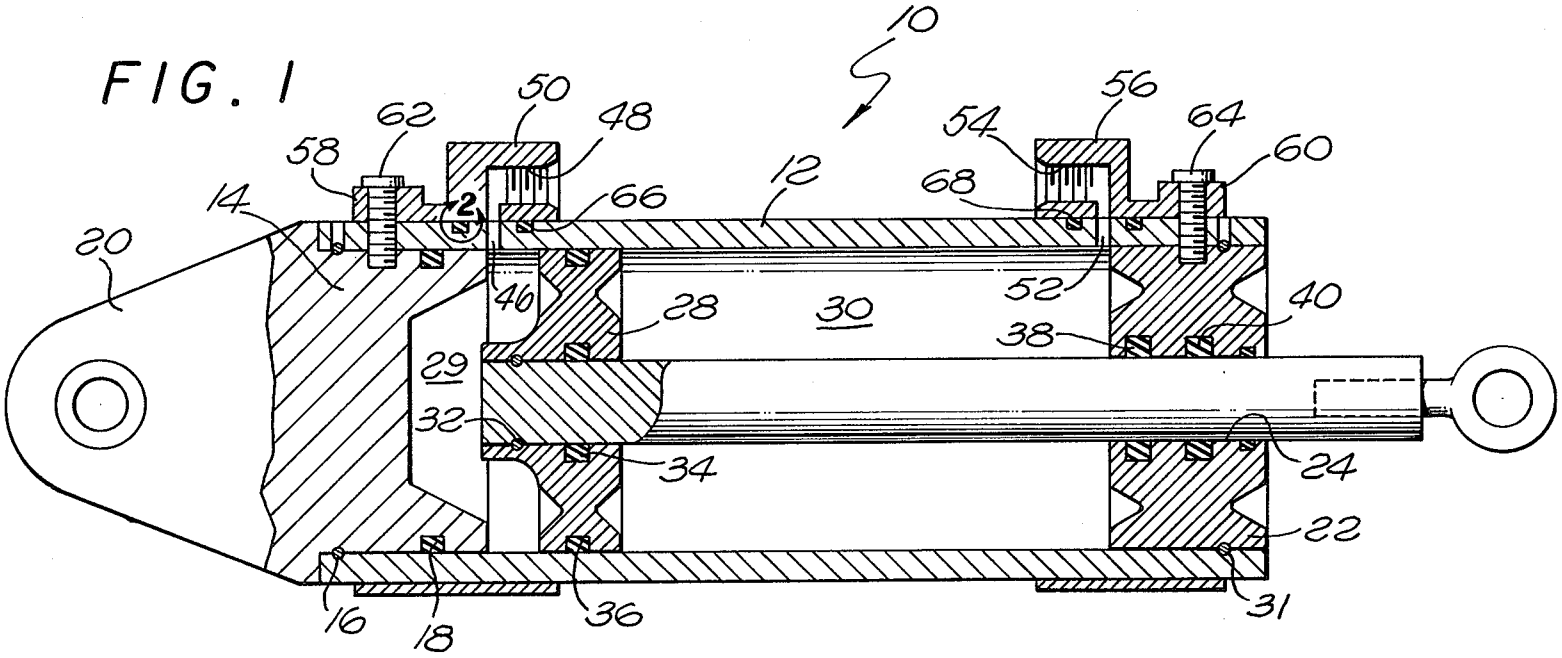
FIG. 1 is a cross sectional drawing of an actuator according to my invention.

The hydraulic actuator, according to my invention, is shown generally at numeral 10, including a barrel section 12 which typically is formed of steel tubing material. The barrel is closed at its head end by means of a head end gland 14 which is securely fastened to the barrel member 10 by means of a feedthrough wire 16. A conventional seal 18 is located in the surface of the head end gland and seals against the inside wall of the barrel 12. A clevis member 20 which may be a part of gland member 14 is provided for attachment of the actuator to a stationary member, not shown. The opposite end of the actuator 10 is closed by means of a rod end gland 22 having an opening 24 through which passes an actuating rod 26 driven by a piston 28, which separates the interior of barrel 12 into chambers 29 and 30. Rod end gland 22 is secured to the inside surface of barrel 12 by means of a feedthrough wire 31 and piston 28 is similarly secured to rod 26 by means of a feedthrough wire 32. Conventional seals 34 and 36, which may be O-ring seals, prevent communication across the piston between the piston 28 and rod 26 and piston 28 and the inside surface of the barrel 12, respectively. Similar seals 38 and 40 prevent high pressure fluid within chamber 30 from leaking along the surface of rod 26 to the exterior of rod end gland 22.

Chambers 29 and 30 are each supplied with hydraulic fluid under high pressure from an external source not shown. Chamber 29 communicates with a port 46 through the sidewall of barrel 12 which in turn communicates with the interior channel 48 of a fitting member 50. Chamber 30 communicates with a port 52 which communicates with a channel 54 in a fitting member 56 which is similar to fitting member 50. Members 50 and 56 are forged or cast as ring-shaped members which surround the barrel 12 and include bosses 58 and 60, respectively, which receive screws 62 and 64, respectively, which are threadedly engaged with the sidewall of barrel 12, and as shown may also penetrate into the head and rod end glands 14 and 22. A pair of face seal grooves 66 and 68 are formed in the sidewall of barrel 12 by electrical discharge machining, multi-axis conventional machining, or other suitable method such that they surround the ports 46 and 52. The fitting members 50 and 56 have internal diameters such that they afford approximately 0.05–0.13 mm (0.002 to 0.005 in.) clearance around the barrel 12 and grooves 66 and 68 may contain conventional O-type ring seals for preventing the high pressure fluid in chambers 29 and 30 from leaking laterally along the outside surface of the barrel 12.

Figure 2:
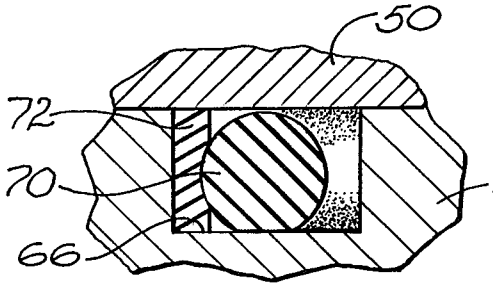
FIG. 2 is an enlarged portion 2—2 of FIG. 1.

As indicated above, it has been determined that the localized force and the strain on the fitting members 50 and 56 is less than the barrel-hoop strain at the same pressure, therefore, the initial face seal annular gap tends to decrease with pressure increase rather than the reverse. A very thin O-ring or similar seal can be used, 1.24–1.50 mm (0.050 to 0.060 inches), more or less, while maintaining this effective seal gap closure. Thus, the fitting can be lightweight, has only one seal or potential leak path and is a removable and replaceable part even with the actuator assembled. The seals in grooves 66 and 68 would normally be of the type utilizing an O-ring of elastomeric material having an outer diameter backup ring of polytetraflorethylene (Teflon) or similar material. Details of such a seal are shown in FIG. 2 wherein groove 66 contains an O-ring 70 which exerts a radially outward force on a Teflon ring 72 which seals against the internal surface of fitting member 50. It will be recognized that O-ring 70 and ring 72 are deformed to follow the contour of barrel 12.

While only a single embodiment has been shown and described herein, those skilled in the art will be aware of modifications within the scope of the present invention.

I claim:

1. A lightweight linear hydraulic actuator including a cylindrical barrel, head end and rod end gland members on opposite ends of said barrel, a piston in said barrel dividing said barrel into first and second chambers, a rod attached to said piston and extending through said rod end gland member, and means connecting a source of hydraulic fluid under pressure to said cylinder on opposite sides of said piston said means including a first port in the sidewall of said barrel communicating with said first chamber and a second port in the sidewall of said barrel communicating with said second chamber, said ports being axially spaced from said end glands, first and second generally circular grooves in the curved sidewall of said barrel surrounding said first and second ports respectively, and seals in said grooves;

a first fitting member having a passageway communicating with said first port, a second fitting member having a passageway communicating with said second port, said fitting members each having hoop supports surrounding said barrel and internal arcuate surfaces mating with the curved surface of said barrel in contact with said seals, and fastening means fastening said fitting members to said barrel.

2. A lightweight linear hydraulic actuator as claimed in claim 1 wherein said fitting members have axially extending extensions and said fastening means includes threaded members threadedly engaged with said barrel and said head end and rod end glands.

3. A lightweight linear hydraulic actuator as claimed in claim 2 wherein said seals include O-rings and outer diameter backup ring seals of low friction material.

4. A lightweight linear hydraulic actuator as claimed in claim 3 where said barrel is formed of tubing and said head and rod end glands are retained in said barrel by means of feedthrough wire rings.

5. A lightweight linear hydraulic actuator including a cylindrical barrel, a head end gland closing one end of said barrel, a rod end gland closing the opposite end of said barrel, a piston in said cylinder dividing said barrel into first and second chambers, a rod attached to said piston and extending through said rod end gland, and means connecting a source of hydraulic fluid under pressure to said cylinder on opposite sides of said piston characterized in that said means includes a first port in the sidewall of said barrel adjacent said head end gland communicating with said first chamber, a second port in the sidewall of said barrel adjacent said rod end gland communicating with said second chamber, said ports being axially spaced from said end glands, first and second grooves in the curved surface of said barrel surrounding said first and second ports, respectively, seals including O-rings in said grooves, first and second fitting members having passageways communicating with said first and second ports, respectively, said fitting members each including hoop supports surrounding said barrel having an arcuate internal surface mating with the surface of said barrel and in contact with one of said O-ring seals, said first fitting member having an axial extension extending to the part of said barrel enclosing a portion of said head end gland, said second fitting member having an axial extension extending to the part of said barrel enclosing a portion of said rod end gland, and threaded fastening members through said axial extensions fastening said fitting members to said barrel and said glands.

6. A lightweight linear hydraulic actuator as claimed in claim 5 wherein said O-ring seals also include outer diameter backup ring seals of low friction material.

7. A lightweight linear hydraulic actuator as claimed in claim 6 wherein said barrel is formed of tubing and said head and rod end glands are retained in said barrel by means of feedthrough wire rings.

8. A lightweight linear hydraulic actuator including a cylindrical barrel of tubing material, a head end gland closing one end of said barrel, a rod end gland closing the opposite end of said barrel, said glands being retained in said barrel by means of feedthrough wire rings, a piston in said cylinder dividing said barrel into first and second chambers, a rod formed of bar stock attached to said piston by means of a feedthrough wire ring, said rod extending through said rod end gland, and means connecting a source of hydraulic fluid under pressure to said cylinder on opposite sides of said piston including a first port in the sidewall of said barrel adjacent said head end gland communicating with said first chamber, a second port in the sidewall of said barrel adjacent said rod end gland communicating with said second chamber, said ports being axially spaced from said end glands, first and second generally circular grooves in the curved surface of said barrel surrounding said ports, O-ring seals in said grooves, first and second fitting members having threaded passageways communicating with said first and second ports, respectively, said fitting members each including a hoop support surrounding said barrel and having an arcuate surface mating with the curved surface of said barrel and in contact with one of said O-ring seals, said first fitting member having an axial extension extending to the part of said barrel enclosing a portion of said head end gland, said second fitting member having an axial extension extending to the part of said barrel enclosing a portion of said rod end gland, and threaded fastening members through said axial extensions fastening said fitting members to said barrel and said glands.

9. A lightweight linear hydraulic actuator as claimed in claim 8 wherein said passageways in said fitting members are oriented substantially parallel with the axis of said barrel.

10. A lightweight linear hydraulic actuator as claimed in claim 8 wherein said O-ring seals also include outer diameter backup ring seals of low friction material.

* * * * *